United States Patent [19]

Morris et al.

[11] Patent Number: 5,006,894

[45] Date of Patent: Apr. 9, 1991

[54] DUST CONTAINMENT CAP FOR A PRINTING DEVICE EMPLOYING TONER

[75] Inventors: Scott S. Morris, Oklahoma City; Danny B. McGehee, Moore; Randolph S. Canham, Yukon, all of Okla.

[73] Assignee: Bull HN Information Systems Inc., Billerica, Mass.

[21] Appl. No.: 449,642

[22] Filed: Dec. 12, 1989

[51] Int. Cl.[5] ..... G03G 21/00

[52] U.S. Cl. ..... 355/215; 141/364; 222/DIG. 1; 355/260

[58] Field of Search ..... 355/200, 210, 215, 260; 222/DIG. 1; 141/360, 363, 364

[56] References Cited

U.S. PATENT DOCUMENTS

| | | | |
|---|---|---|---|
| 4,237,943 | 12/1980 | Ermel et al. | 141/364 X |
| 4,373,468 | 2/1983 | Suda et al. | 355/260 X |
| 4,492,321 | 1/1985 | Zoltner | 222/DIG. 1 |
| 4,634,071 | 1/1987 | Hertel | 354/277 X |

FOREIGN PATENT DOCUMENTS

| | | | |
|---|---|---|---|
| 59-62881 | 4/1984 | Japan | 355/260 |
| 59-67562 | 4/1984 | Japan | 355/260 |
| 60-91371 | 5/1985 | Japan | 355/260 |
| 60-151669 | 8/1985 | Japan | 355/260 |
| 60-151670 | 8/1985 | Japan | 355/260 |
| 60-230173 | 11/1985 | Japan | 355/260 |
| 61-55672 | 3/1986 | Japan | 355/260 |
| 63-89880 | 4/1988 | Japan | 355/260 |

*Primary Examiner*—Fred L. Braun

*Attorney, Agent, or Firm*—Gary D. Clapp; John S. Solakian

[57] ABSTRACT

A dust containment cap for use in a printing device to be supplied with finely pulverized toner which is susceptible of becoming airborne and contaminating surrounding areas employs two brushes arranged in the toner supply opening such that they completely fill the opening but permit the insertion of the neck of a toner bottle to be inserted through them for depositing new toner. Toner that becomes airborne below the brushes is impeded by the brushes from escaping from the opening. The brushes may be installed at downward angles so that together they form a "V"; toner inadvertently spilled on the tops of the brushes gravitates to the bottom of the "V" whence it may be dropped through by agitating the bristles.

9 Claims, 2 Drawing Sheets

DUST CONTAINMENT CAP FOR A PRINTING DEVICE EMPLOYING TONER

FIELD OF THE INVENTION

This invention relates to printing devices of the electrostatic, triboelectric, or laser type in which a finely pulverized light-absorbing material ("toner") is deployed on a sheetlike medium (usually paper) in the configuration of a desired image and then permanently fixed to the medium in that configuration, and particularly to means for controlling the spread of airborne dust resulting from handling the supply of toner.

BACKGROUND OF THE INVENTION

Printing devices requiring a supply of "toner", a very finely pulverized light-absorbing (and therefore usually black) particulate material, are very well known in the art, being found in virtually every office environment in the form of "copy machines" for copying documents or "laser printers" associated with data processing or data transmission systems.

Such a device is typically equipped with a bin-like receptacle for containing its supply of toner. Because the toner is very finely pulverized in order to facilitate its deployment in the configuration of an image without introducing undue distortions caused by the toner's granularity, toner particles are very susceptible of becoming airborne when handled, thus contaminating the surrounding area.

Well known in the art for limiting such dust contamination is the toner bottle having a long, relatively narrow neck. The bottle may be inverted and the neck inserted into the toner receptacle for the filling thereof. If care is employed in inverting the bottle, little or no toner will be spilled outside of the receptacle. Once the bottle is fully inverted, the toner, being finely pulverized, is able to flow because of gravity through the narrow neck and emerge into the receptacle. The flow may be abetted by shaking the bottle, or by squeezing it if it is of a flexible material. Upon the toner's emerging from the bottle and falling to the bottom of the receptacle, a portion of it will become airborne in the form of dust, and may escape from the receptacle and eventually settle on surrounding objects. Its light-absorbing qualities, which usually impart to it a deep a black appearance, render this a messy and objectionable condition.

It is thus a general object of the present invention to provide improved toner-supplied printing devices.

It is a particular object of the present invention to provide toner-supplied printing devices with means for limiting the dust contamination engendered by refilling the supply of toner.

SUMMARY OF THE INVENTION

The present invention ameliorates the dust contamination problem of the prior art by providing a dust containment cap for the toner bin of a printing device which inhibits airborne toner dust released within the receptacle from escaping therefrom, while not impeding the insertion or use of a long-necked toner filler bottle.

The present invention provides a pair of bristle-type brushes mounted just within the opening of the toner receptacle, the bristles being anchored along both sides of the opening and extending inward across the opening. The bristles are slightly longer than half the width of the opening, resulting in a small overlap along the midline of the opening. The neck of a filler bottle may be inserted without difficulty through the bristles, whereupon the bristles will form around the neck, effecting a seal. Dust released within the receptacle upon ejecting toner is impeded by the bristles from rising out through the opening. To facilitate depositing toner evenly throughout the receptacle, the filler bottle may be moved along the length of the opening, and the bristles will constantly form around the neck and maintain the seal.

Other objects and advantages of the present invention will become apparent to those skilled in the art after reviewing the following detailed description and the appended drawings, wherein:

DETAILED DESCRIPTION

Figure 1:
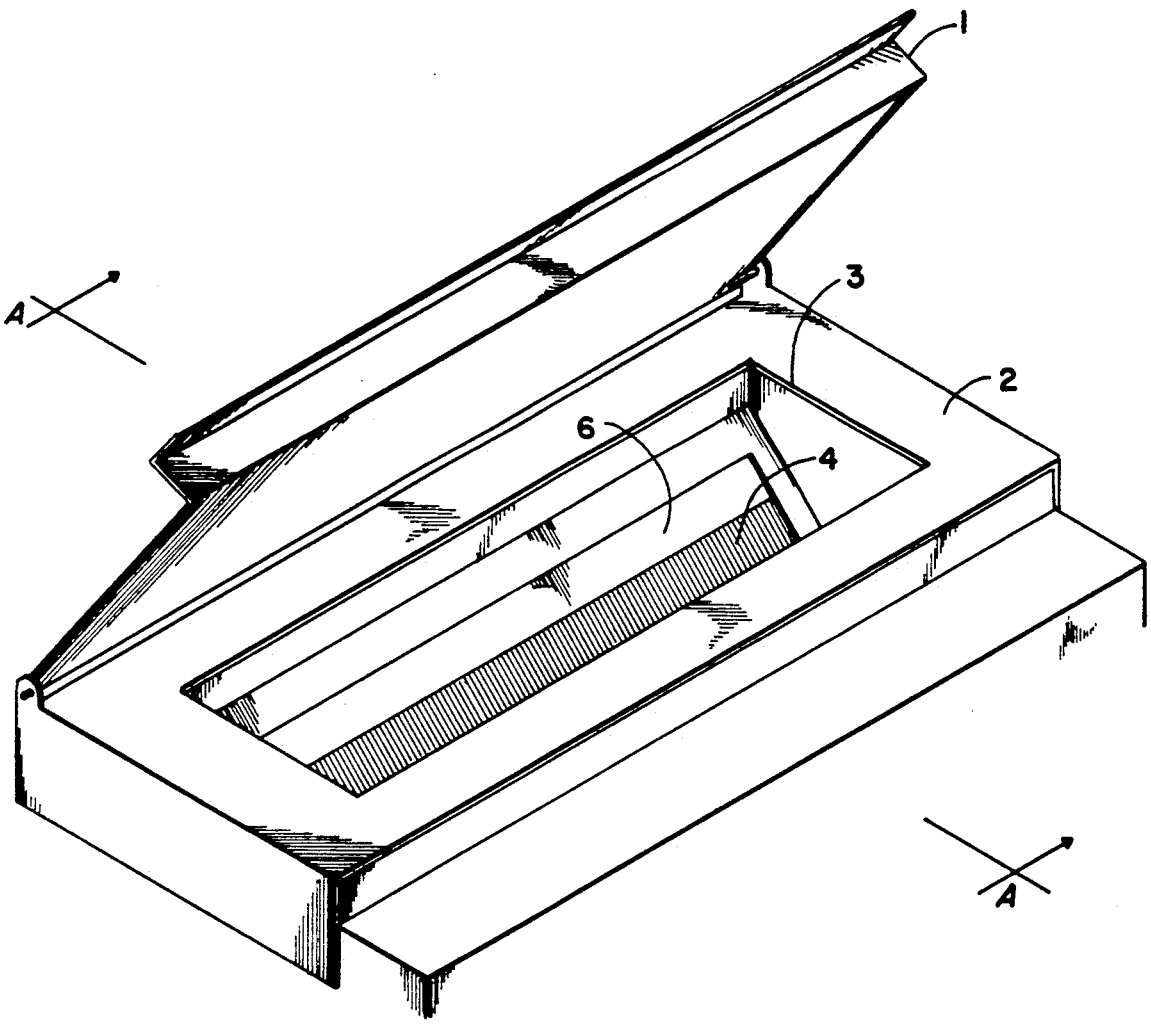
FIG. 1 is an isometric drawing of that portion of a toner-supplied printing device which contains the toner receptacle and the opening through which the toner receptacle may be replenished.
Figure 2:
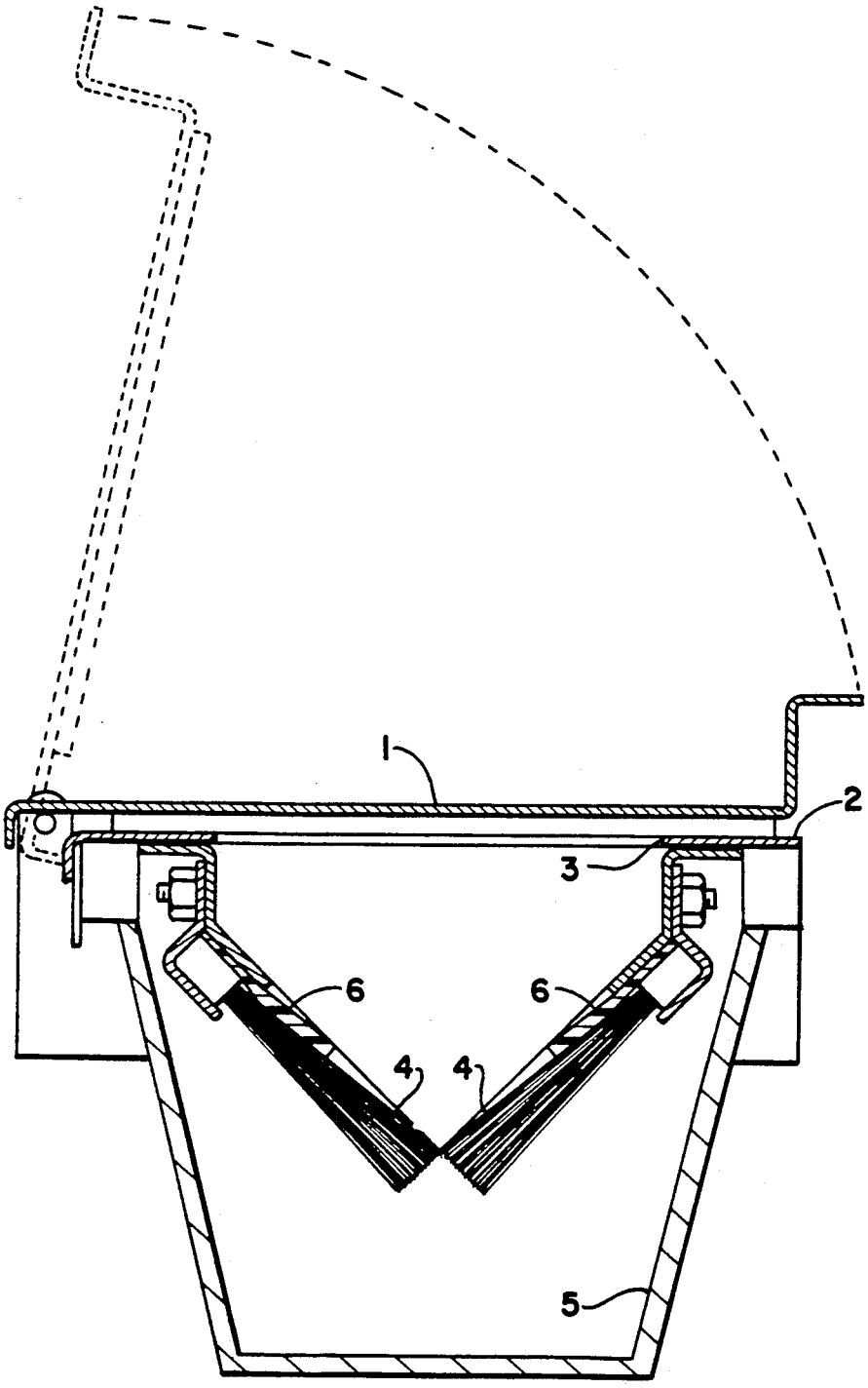
FIG. 2 is a cross-sectional view of the portion of the printing device depicted in FIG. 1.

FIG. 1 depicts the portion of a toner-supplied printing device containing the toner receptacle. Opening a hinged cover 1 reveals the platelike member 2 having rectangular opening 3 through which toner may be loaded into the toner receptacle (located beneath platelike member 2 and not visible in FIG. 1). One of brushes 4 is visible in FIG. 1, and is seen to be positioned such that the neck of a filler bottle can be inserted through its bristles in order to inject toner down into the receptacle. FIG. 2 is a cross-sectional view at the section A—A which is noted on FIG. 1. Hinged cover plate 1, platelike member 2, and opening 3 are again visible in FIG. 2. Also visible are both of the brushes 4, and the toner receptacle 5.

It is evident from FIGS. 1 and 2 taken together that the brushes 4 are mounted along the two long sides of opening 3, are of sufficient width to occupy substantially the full length of opening 3, and have bristles of sufficient length that the two brushes occupy the full width of opening 3 with a slight overlap where the tips of the bristles from the two brushes meet.

This forms a seal over the opening through which the neck of a filler bottle may be inserted. The bristles will form around the neck of the bottle, maintaining the seal. The seal impedes dust generated from the depositing of toner from arising out of the opening. The filler bottle may be moved along the length of the opening while depositing toner, in order to deposit it evenly along the length of the receptacle 5, and the bristles continually form around the neck of the bottle to maintain the seal.

In the preferred embodiment, as shown in FIG. 2, the brushes are mounted at a 45 degree angle with the horizontal so as to form a "V". This is so that any toner that may be spilled on the tops of the brushes (as when first inverting the filler bottle) will gravitate down to the bottom of the "V" whence they will tend to fall into the receptacle the next time the brush tips are manipulated, as by drawing the neck of the filler bottle along the length of the opening, as might be done to ensure even depositing of toner in the receptacle. However, the brushes will still perform their sealing function if the designer elects to mount them horizontally.

Each of brushes 4 is faced with a flexible strip 6 of cellular polyurethane foam, which assists with the sealing, and which further forms a smooth ramp encouraging toner which settles on its top to gravitate down and into the toner bin. When first inverting and inserting the toner bottle, there is a tendency to spill some toner on top of the brushes, which is ameliorated by strip 6.

In the present embodiment, visibility for the operator replenishing the toner is enhanced by painting the bottom surface of the hinged cover 1 and the top surface of the platelike member 2 a light color, thus maximizing the reflectance of incident light.

The invention may be embodied in other forms without departing from the spirit thereof. The invention is intended to be embraced by the appended claims and not limited by the foregoing description of a particular preferred embodiment.

We claim:

1. In an electrostatic printing device employing powdered toner and having a receptacle for receiving said powdered toner, said receptacle having a substantially horizontal top platelike member having a substantially rectangular opening for replenishing said toner, a dust containment cap for use in said opening, the dust containment cap comprising:

a pair of brushes each comprising an elongate member substantially equal in length to the length of the rectangular opening and having a plurality of bristles protruding from the elongate member along substantially all of its length, the bristles being substantially parallel to one another, substantially coplanar, substantially perpendicular to the elongate member, and slightly longer than half the width of the rectangular opening, the brushes being mounted by their elongate members to the underside of the top platelike member along opposite long sides of the rectangular opening, each with its bristles substantially horizontal and oriented toward the principal axis of the rectangular opening, whereby the tips of the bristles of each brush overlap slightly with the tips of the bristles of the other brush along a line substantially parallel to and slightly below the principal axis of the rectangular opening, whereby further, the bristles form around a nozzle of a toner dispenser inserted through the opening, and whereby further, toner particles which become airborne within the receptacle in conjunction with the dispensing of toner through the nozzle are impeded by the bristles from escaping from the receptacle.

2. The dust containment cap recited in claim 1, further comprising a cover plate pivotably mounted on an axis substantially coplanar with the horizontal platelike member, closable to cover the rectangular opening and openable to uncover the rectangular opening.

3. The dust containment cap recited in claim 2, wherein further the cover plate is a light color, whereby reflection of incident light to the rectangular opening is enhanced.

4. In an electrostatic printing device employing powdered toner and having a receptacle for receiving said powdered toner, said receptacle having a substantially horizontal top platelike member having a substantially rectangular opening for replenishing said toner, a dust containment cap for use in said opening, the dust containment cap comprising:

a pair of brushes each comprising an elongate member substantially equal in length to the length of the rectangular opening and having a plurality of bristles protruding from the elongate member along substantially all of its length, the bristles being substantially parallel to one another, substantially coplanar, and substantially perpendicular to the elongate member, the brushes being mounted by their elongate members to the underside of the top platelike member along opposite long sides of the rectangular opening, each with its bristles slanting downward toward a vertical plane including the principal axis of the rectangular opening, the bristles of each brush being substantially equal in length to the bristles of the other brush, that length being such that the tips of the bristles of the two brushes overlap slightly along a line parallel to and somewhat below the principal axis of the rectangular opening whereby the bristles form around a nozzle of a toner dispenser inserted through the opening, whereby further, toner particles which become airborne within the receptacle in conjunction with the dispensing of toner through the nozzle are impeded by the bristles from escaping from the receptacle, and whereby further, toner particles which puddle on top of the bristles tend to gravitate downward toward the line of bristle overlap whence they may be deposited into the receptacle by manipulation of the bristles.

5. The dust containment cap recited in claim 4, further comprising a cover plate pivotably mounted on an axis substantially coplanar with the horizontal platelike member, closable to cover the rectangular opening and openable to uncover the rectangular opening.

6. The dust containment cap recited in claim 5, wherein further the cover plate is a light color, whereby reflection of incident light to the rectangular opening is enhanced.

7. In an electrostatic printing device employing powdered toner and having a receptacle for receiving said powdered toner, said receptacle having a substantially horizontal top platelike member having a substantially rectangular opening for replenishing said toner, a dust containment cap for use in said opening, the dust containment cap comprising:

a pair of brushes each comprising a elongate member substantially equal in length to the length of the rectangular opening and having a plurality of bristles protruding from the elongate member along substantially all of its length, the bristles being substantially parallel to one another, substantially coplanar, and substantially perpendicular to the elongate member, the brushes being mounted by their elongate members to the underside of the top platelike member along opposite long sides of the rectangular opening, each with its bristles slanting downward toward a vertical plane including the principal axis of the rectangular opening, and the bristles of each brush being substantially equal in length to the bristles of the other brush, that length being such that the tips of the bristles of the two brushes overlap slightly along a line parallel to and somewhat below the principal axis of the rectangular opening, whereby the bristles form around a nozzle of a toner dispenser inserted through the opening, whereby further, toner particles which become airborne within the receptacle in conjunction with the dispensing of toner through the nozzle are impeded by the bristles from escaping from the receptacle, and whereby further, toner particles which puddle on top of the bristles tend to gravitate downward toward the line of bristle overlap whence they may be deposited into the receptacle by manipulation of the bristles, and a flat flexible member mounted against the upper side of the brush bristles and having a length substantially equal to the lengths of said elongate members and a width substantially equal to or slightly less than the lengths of said bristles, whereby escaping of airborne toner is further impeded, and whereby gravitation into the toner receptacle of toner spilled on the tops of the brushes is enchanced.

8. In an electrostatic printing device employing powdered toner and having a receptacle for receiving said powdered toner, said receptacle having a substantially horizontal top platelike member having a substantially rectangular opening for replenishing said toner, a dust containment cap for use in said opening, the dust containment cap comprising:

a pair of brushes each comprising a elongate member substantially equal in length to the length of the rectangular opening and having a plurality of bristles protruding from the elongate member along substantially all of its length, the bristles being substantially perpendicular to one another, substantially coplanar, and substantially perpendicular to the elongate member, the brushes being mounted by their elongate members to the underside of the top platelike member along opposite long sides of the rectangular opening, each with its bristles slanting downward toward a vertical plane including the principal axis of the rectangular opening, the bristles of each brush being substantially equal in length to the bristles of the other brush, that length being such that the tips of the bristles of the two brushes overlap slightly along a line parallel to and somewhat below the principal axis of the rectangular opening, whereby the bristles form around a nozzle of a toner dispenser inserted through the opening, whereby further, toner particles which become airborne within the receptacle in conjunction with the dispensing of toner through the nozzle are impeded by the bristles from escaping from the receptacle, and whereby further, toner particles which puddle on top of the bristles tend to gravitate downward toward the line of bristle overlap whence they may be deposited into the receptacle by manipulation of the bristles, a flat flexible member mounted against the upper side of the brush bristles and having a length substantially equal to the lengths of said elongate members and a width substantially equal to or slightly less than the lengths of said bristles, whereby escaping of airborne toner is further impeded, and whereby gravitation into the toner receptacle of toner spilled on the tops of the brushes is enhanced, and a cover plate pivotably mounted on an axis substantially coplanar with the horizontal platelike member, closable to cover the rectangular opening and openable to uncover the rectangular opening.

9. The dust containment cap recited in claim 8, wherein further the cover plate is a light color, whereby reflection of incident light to the rectangular opening is enhanced.

* * * * *